US008971777B2

(12) United States Patent
Ryu et al.

(10) Patent No.: US 8,971,777 B2
(45) Date of Patent: Mar. 3, 2015

(54) FIXING DEVICE, IMAGE FORMING APPARATUS, AND FIXING METHOD

(75) Inventors: Takayuki Ryu, Kanagawa (JP); Yasutaka Gotoh, Kanagawa (JP); Yuki Kubota, Kanagawa (JP); Koji Okabe, Kanagawa (JP); Jouta Kobayashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/569,383

(22) Filed: Aug. 8, 2012

(65) Prior Publication Data

US 2013/0251421 A1 Sep. 26, 2013

(30) Foreign Application Priority Data

Mar. 26, 2012 (JP) ..... 2012-069244

(51) Int. Cl.
*G03G 15/20* (2006.01)

(52) U.S. Cl.
USPC ..... 399/329

(58) Field of Classification Search
USPC ..... 399/322, 328, 329, 406
See application file for complete search history.

(56) References Cited

U.S. PATENT DOCUMENTS

2009/0317154 A1* 12/2009 Nishinoue et al. ..... 399/329

FOREIGN PATENT DOCUMENTS

| | | | |
|---|---|---|---|
| EP | 2 104 003 A2 | | 9/2009 |
| JP | 2009-69226 A | | 4/2009 |
| JP | 2009109931 A | * | 5/2009 |
| JP | 2010-2773 A | | 1/2010 |

OTHER PUBLICATIONS

Onishi et al. (JP 2009-109931 A), May 2009, JPO Computer Translation.*

* cited by examiner

*Primary Examiner* — Erika J Villaluna
(74) *Attorney, Agent, or Firm* — Sughrue Mion, PLLC

(57) ABSTRACT

A fixing device includes: a cylinder member that rotates in a circumferential direction thereof; a circulating member that circularly moves in a circumferential direction thereof and is pressed against the cylinder member; a heat source that heats a recording medium holding an unfixed toner image and nipped between the cylinder member and the circulating member; and a pressing member provided inside the circulating member, and including a nip forming portion that presses the circulating member against the cylinder member to form a nip region therebetween, and a thrusting portion that thrusts, upstream of the nip forming portion in a moving direction of the circulating member, and from inside the circulating member toward the cylinder member, the circulating member before being pressed against the cylinder member such that the thrust is greater in end portions of the circulating member than in a central portion of the circulating member.

6 Claims, 9 Drawing Sheets

FIXING DEVICE, IMAGE FORMING APPARATUS, AND FIXING METHOD

CROSS-REFERENCE TO RELATED APPLICATIONS

This application is based on and claims priority under 35 USC 119 from Japanese Patent Application No. 2012-069244 filed Mar. 26, 2012.

BACKGROUND (i) Technical Field

The present invention relates to a fixing device, an image forming apparatus, and a fixing method.

(ii) Related Art

In the past, an electrophotographic image forming apparatus including a fixing device which fixes an unfixed toner image on a recording medium has been known.

SUMMARY

According to an aspect of the invention, there is provided a fixing device including a cylinder member, a circulating member, a heat source, and a pressing member. The cylinder member, which has a shape of a cylinder and is elastically deformed in a direction of crushing the cylinder, rotates in a circumferential direction of the cylinder. The circulating member, which has a shape of a cylinder, circularly moves in a circumferential direction of the cylinder with an outer circumferential surface thereof pressed against the cylinder member. The heat source heats a recording medium which holds an unfixed toner image on a surface thereof, and which is nipped between the cylinder member and the circulating member. The pressing member, which is provided inside the circulating member, presses the circulating member against the cylinder member from inside the circulating member. The pressing member includes a nip forming portion and a thrusting portion. The nip forming portion presses the circulating member and brings the circulating member and the cylinder member into contact with each other, to thereby form a nip region therebetween. The thrusting portion thrusts, at a position upstream of the nip forming portion in a moving direction of the circulating member, and from inside the circulating member toward the cylinder member, the circulating member before being pressed against the cylinder member such that the thrust is greater in end portions of the circulating member than in a central portion of the circulating member.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

Figure 1:
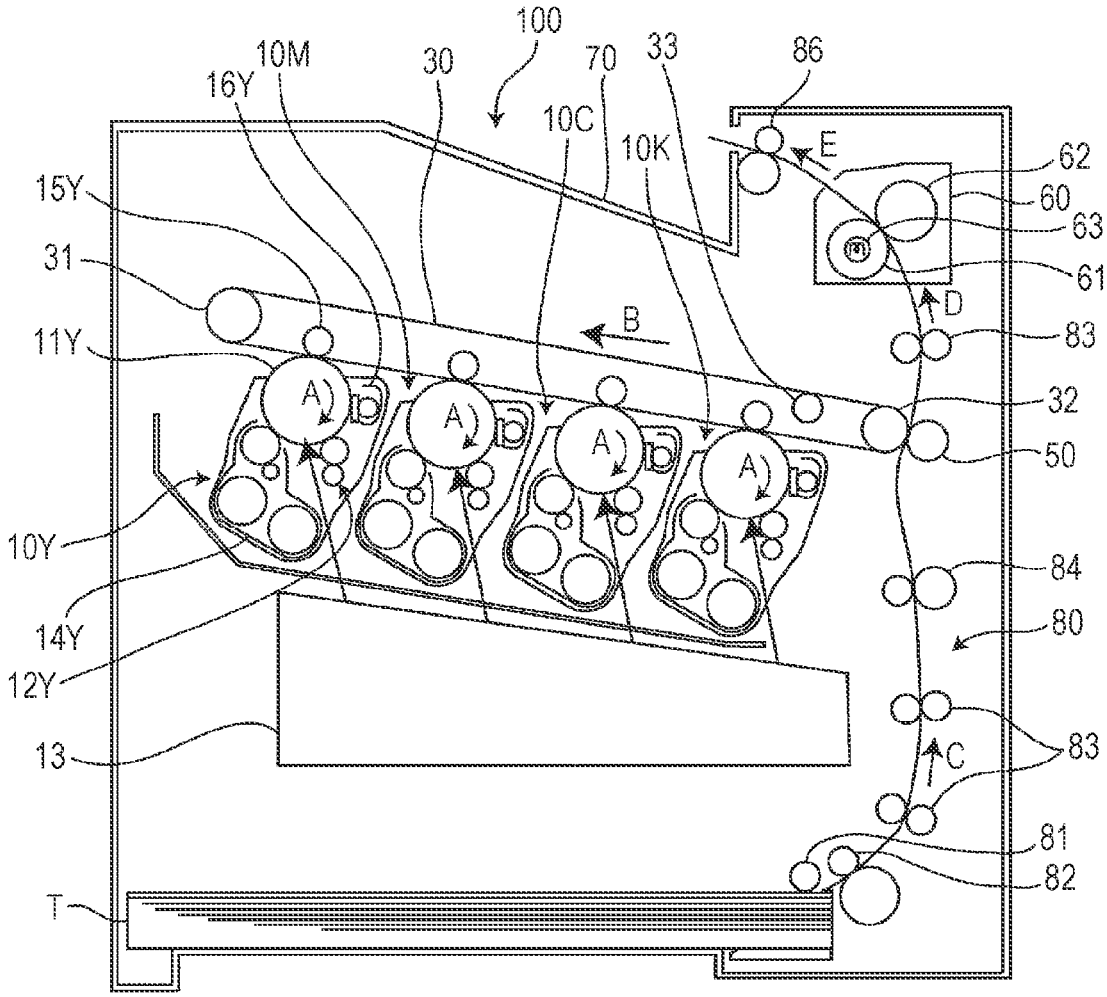
FIG. 1 is a schematic configuration diagram illustrating a printer corresponding to a first exemplary embodiment of an image forming apparatus of the invention.

FIG. 1 is a schematic configuration diagram illustrating a printer corresponding to a first exemplary embodiment of an image forming apparatus of the invention.

A printer 100 illustrated in FIG. 1 is a tandem-type color printer including juxtaposed image forming units 10Y, 10M, 10C, and 10K for yellow (Y), magenta (M), cyan (C), and black (K) colors, respectively. The printer 100 is capable of printing an image of a single color and a full-color image formed by toner images of four colors. Further, the printer 100 is an apparatus capable of handling not only a paper sheet, i.e., a recording medium made of paper but also a recording medium made of a resin, which is typified by an overhead projector (OHP) sheet. The following description will be made on the assumption that the recording medium is represented by the paper sheet, unless otherwise specified.

The printer 100 includes one exposure device 13 for the four image forming units 10Y, 10M, 10C, and 10K.

The four image forming units 10Y, 10M, 10C, and 10K are similar in configuration, including size and material. Thus, the image forming unit 10Y corresponding to the yellow color will be described as a representative of the image forming units 10Y, 10M, 10C, and 10K. The image forming unit 10Y includes a photoconductor 11Y, a charging device 12Y, a developing device 14Y, a first transfer device 15Y, and a photoconductor cleaner 16Y.

The photoconductor 11Y has the shape of a cylinder, and extends in the depth direction of FIG. 1. When a surface of the photoconductor 11Y is charged, the photoconductor 11Y holds charge. Further, when exposed to light, the photoconductor 11Y releases the charge. Thereby, an electrostatic latent image is formed on the surface of the photoconductor 11Y. The photoconductor 11Y rotates around the axis of the cylinder thereof in the direction indicated by an arrow A, while holding an image (electrostatic latent image or toner image) formed on the surface thereof. The charging device 12Y, the developing device 14Y, the first transfer device 15Y, and the photoconductor cleaner 16Y are sequentially disposed around the circumference of the photoconductor 11Y.

The charging device 12Y includes a charging roller which rotates while in contact with the surface of the photoconductor 11Y. The charging device 12Y applies charge to the surface of the photoconductor 11Y by using the charging roller, to thereby charge the surface. As well as the charging roller, a corona discharging device not in contact with the photoconductor 11Y may be employed as the charging device 12Y.

The exposure device 13 includes a light emitting device which emits laser light modulated in accordance with an image signal supplied from outside the printer 100, and a rotary polygon mirror for scanning the photoconductor 11Y with the laser light. The exposure device 13 radiates the laser light to the photoconductor 11Y, to thereby expose the surface of the photoconductor 11Y to the light and form an electrostatic latent image on the surface. As well as the system using the laser light, a light-emitting diode (LED) array including multiple LEDs aligned along a scanning direction may be employed as the exposure device 13.

The developing device 14Y develops the latent image on the surface of the photoconductor 11Y by using a two-component developer formed by a toner and a magnetic carrier. The developing device 14Y is supplied, as required, with the toner from a toner cartridge, the illustration of which is omitted. The toner is mixed and stirred with the magnetic carrier in the developing device 14Y, and thereby is charged. The developing device 14Y develops the latent image on the surface of the photoconductor 11Y with the charged toner in the developer. With this development process, a toner image is formed ob the surface of the photoconductor 11Y.

The first transfer device 15Y serves as a roller facing the photoconductor 11Y across an intermediate transfer belt 30. The first transfer device 15Y includes a conductive elastic layer on a surface thereof. The first transfer device 15Y is applied with a voltage having a polarity opposite to a toner charging polarity, to thereby electrostatically attract the toner image on the photoconductor 11Y to the intermediate transfer belt 30.

The photoconductor cleaner 16Y includes a cleaning blade in contact with the surface of the photoconductor 11Y, and cleans the surface of the photoconductor 11Y after the transfer. More specifically, residual toner, an external additive, and paper dust are scraped off the surface of the photoconductor 11Y by the cleaning blade. As well as the system including the cleaning blade, a system which performs the cleaning by using a charged brush or nonwoven fabric may be employed as the photoconductor cleaner 16Y.

The printer 100 further includes the intermediate transfer belt 30, a fixing device 60, and a sheet transport unit 80. The intermediate transfer belt 30 is an endless belt made of a resin material containing a charge preventing agent. The intermediate transfer belt 30 is stretched over belt support rollers 31 to 33, and circularly moves in the direction indicated by an arrow B via the image forming units 10Y, 10M, 10C, and 10K and a second transfer device 50. The toner images of the respective colors are transferred to the intermediate transfer belt 30 from the image forming units 10Y, 10M, 10C, and 10K. The intermediate transfer belt 30 moves while holding the toner image of the respective colors.

The sheet transport unit 80 includes a pickup roller 81 which picks up sheets stored in a sheet container T, separation rollers 82 which separate the picked-up sheets, transport rollers 83 which transport the sheets, registration rollers 84 which transport the sheets to the second transfer device 50, and discharge rollers 86 which discharge the sheets to the outside. The sheets stored in the sheet container T are picked up by the pickup roller 81, and are separated from one another by the separation rollers 82. Thereafter, each of the sheets is transported in the direction of an arrow C by the transport rollers 83, and reaches the registration rollers 84. The registration rollers 84 transport the sheet such that the sheet arrives a position facing the second transfer device 50 in synchronization with the arrival of the toner image on the intermediate transfer belt 30 to the position.

The second transfer device 50 serves as a roller which rotates while nipping the intermediate transfer belt 30 and the sheet between the second transfer device 50 and a backup roller 32 included in the belt support rollers 31 to 33. The second transfer device 50 includes a conductive elastic layer on a surface thereof. The second transfer device 50 is applied with a voltage having a polarity opposite to the toner charging polarity, to thereby electrostatically attract the toner image on the intermediate transfer belt 30 to the sheet.

The combination of the image forming units 10Y, 10M, 100, and 10K, the intermediate transfer belt 30, and the second transfer device 50 corresponds to an example of an image forming device of the invention.

The sheet subjected to the transfer of the toner image is further transported in the direction of an arrow D by the transport rollers 83, and enters the fixing device 60. The fixing device 60 includes therein a fixing roller 61 and a pressure structure 62. The fixing roller 61 includes therein a heater 63. In the fixing roller 61, the sheet formed with the unfixed toner image is passed through between the fixing roller 61 and the pressure structure 62 while being nipped therebetween. Then, the sheet is heated by the heater 63. Thereby, the toner image is fixed on the sheet. The fixing device 60 corresponds to an exemplary embodiment of a fixing device of the invention.

The sheet having passed the fixing device 60 proceeds in the direction of an arrow E toward the discharge rollers 86, and is further transported and discharged onto a sheet exit tray 70 by the discharge rollers 86.

Subsequently, details of the fixing device 60 will be described.

Figure 2:
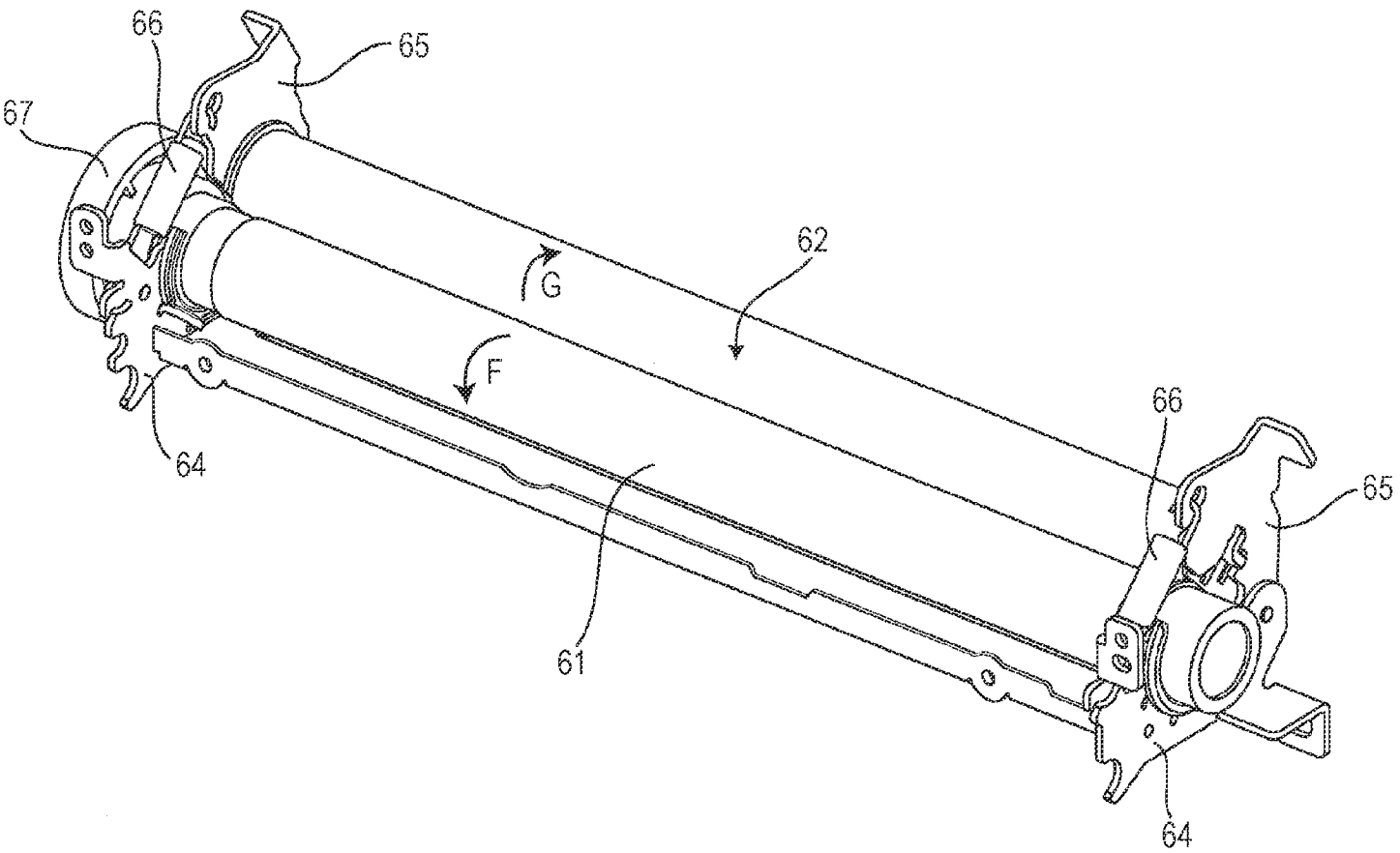
FIG. 2 is a perspective view illustrating major structural components in a fixing device.

FIG. 2 is a perspective view illustrating major structural components in the fixing device 60.

As described above, the fixing device 60 includes therein the fixing roller 61 and the pressure structure 62, and the fixing roller 61 includes therein the heater 63.

The fixing roller 61 is formed by a metal cylinder having an outer circumferential surface coated with a release material, and has opposite ends respectively rotatably supported by fixing roller support members 64. Further, one of the ends of the fixing roller 61 is attached with a drive gear 67. The fixing roller 61 rotates in the direction of an arrow F with rotational drive force received via the drive gear 67. The fixing roller 61 corresponds to an example of a cylinder member of the invention, and the heater 63 included in the fixing roller 61 corresponds to an example a heat source of the invention.

The pressure structure 62 has opposite ends respectively supported by pressure arms 65. Further, the pressure arms 65 are respectively biased toward the fixing roller support members 64 by pressure springs 66. Thereby, the pressure structure 62 is firmly pressed against the fixing roller 61. As described later, a surface of the pressure structure 62 is formed by a belt, and the belt circularly moves in the direction of an arrow G in accordance with the rotation of the fixing roller 61. As a result, the sheet nipped between the pressure structure 62 and the fixing roller 61 is transported to the near side of the drawing.

Figure 3:
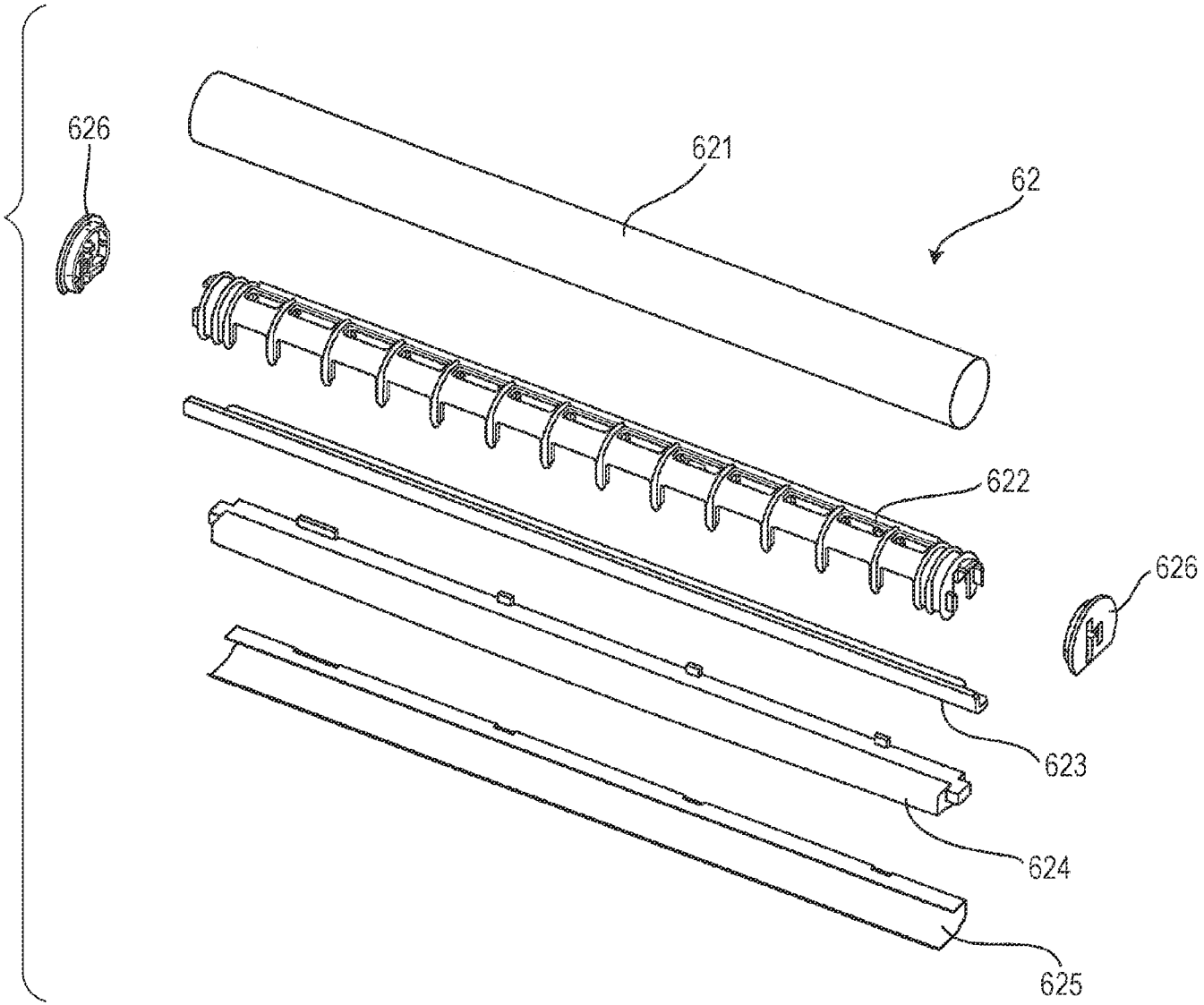
FIG. 3 is an exploded perspective view illustrating a structure of a pressure structure.

FIG. 3 is an exploded perspective view illustrating a structure of the pressure structure 62.

The pressure structure 62 includes a belt 621, a belt guide member 622, a support member 623, a pressure block 624, a lubricant sheet 625, and end surface covers 626. The belt 621 is a member forming a circumferential surface of the pressure structure 62 formed into a rod shape as a whole. As described above, the belt 621 circularly moves in accordance with the rotation of the fixing roller 61. The belt 621 corresponds to an example of a circulating member of the invention.

The belt guide member 622 is a member which guides, inside the belt 621, such circular movement of the belt 621. The belt 621 circularly moves in an unstretched state, and thus is loosely guided by the belt guide member 622. The support member 623 is fit in the belt guide member 622, and supports the pressure block 624. Supported by the support member 623, the pressure block 624 presses the belt 621 from inside the belt 621, to thereby press the belt 621 against the fixing roller 61 (see FIG. 2). The pressure block 624 corresponds to the combination of an example of a pressing member of the invention and an example of a thrusting member of the invention.

The lubricant sheet 625 is a member which covers the pressure block 624 to enhance the lubricity of the belt 621 on the pressure block 624.

With the belt 621 pressed against the fixing roller 61 by the pressure block 624, a nip region is formed between the pressure structure 62 and the fixing roller 61.

Figure 4:
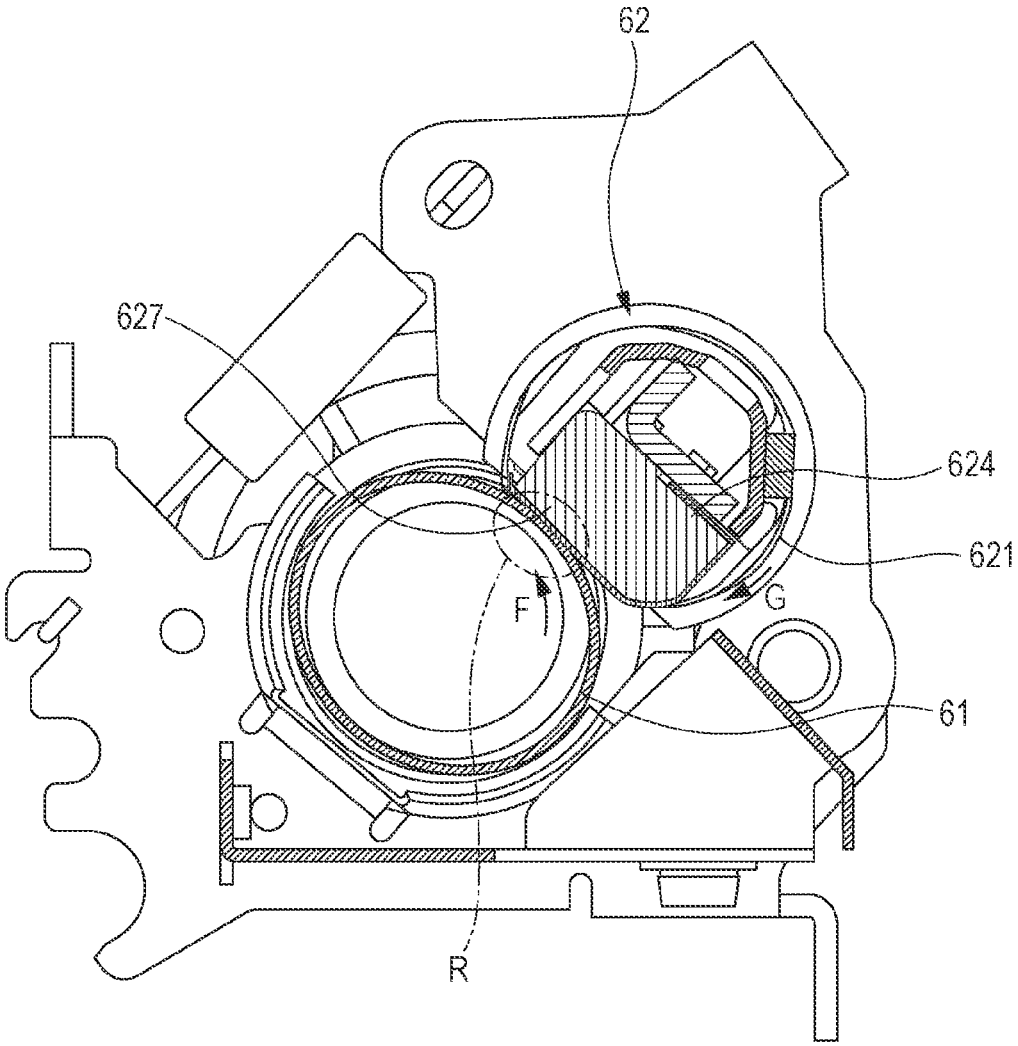
FIG. 4 is a cross-sectional view of a central portion of the fixing device.
Figure 5:
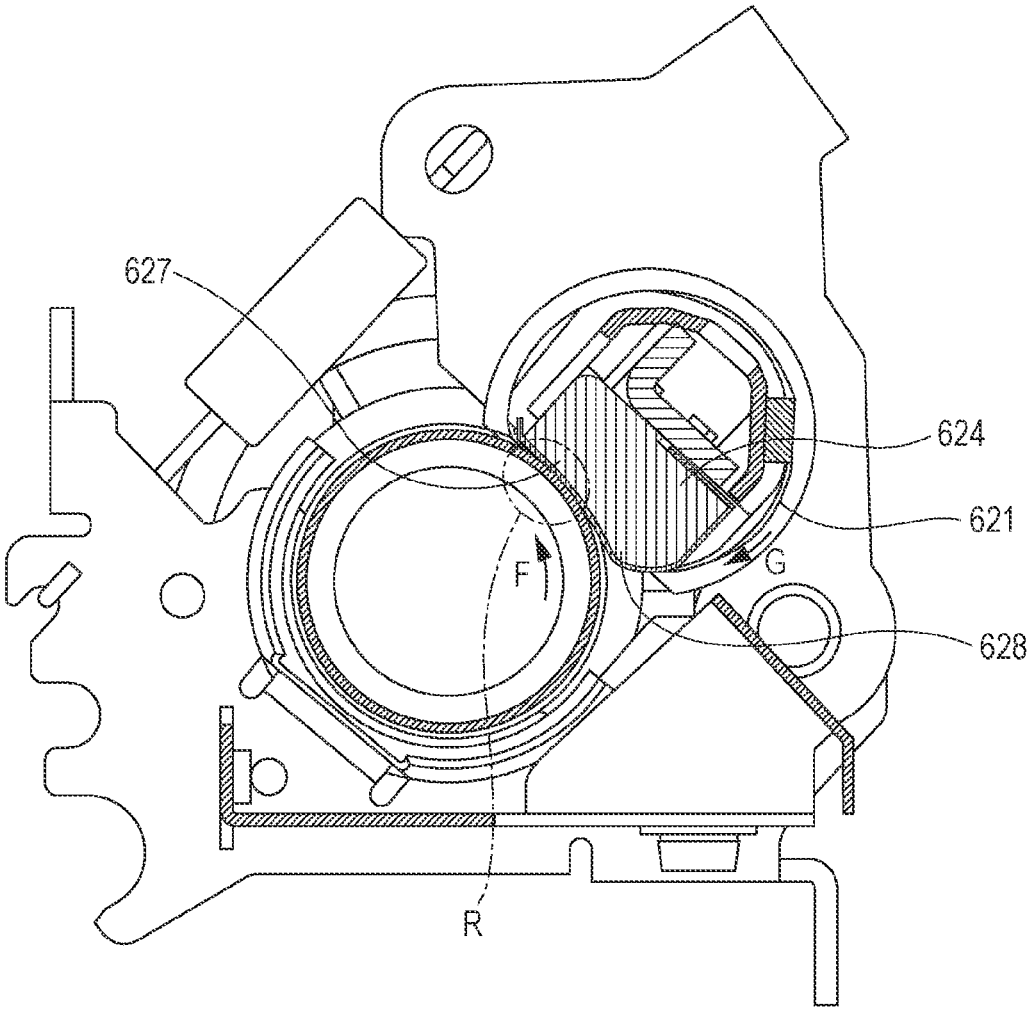
FIG. 5 is a cross-sectional view of an end portion of the fixing device.

FIG. 4 is a cross-sectional view of a central portion of the fixing device 60, and FIG. 5 is a cross-sectional view of an end portion of the fixing device 60.

As illustrated in FIGS. 4 and 5, a nip region R is formed between a nip forming portion 627 of the pressure block 624 and the fixing roller 61. The nip forming portion 627 is a part of the pressure block 624 located on the downstream side in the rotation direction F of the fixing roller 61 and the circular movement direction G of the belt 621, and serves as an example of the pressing member of the invention. Further, at a position upstream of the nip forming portion 627 in the rotation direction F of the fixing roller 61 and the circular movement direction G of the belt 621, a belt thrusting portion 628 is provided. The belt thrusting portion 628 thrusts the belt 621 toward the fixing roller 61 at a position upstream of the nip region R, and serves as an example of the thrusting member of the invention. Further, the thrust exerted on the belt 621 by the belt thrusting portion 628 is greater in the end portion illustrated in FIG. 5 than in the central portion illustrated in FIG. 4.

With the belt 621 pressed against the fixing roller 61 by the thus configured pressure block 624, the fixing roller 61 is elastically deformed in a direction of crushing the cylinder thereof, and is also elastically deformed in a direction of flexing a central portion of the cylinder relative to the opposite ends of the cylinder. Meanwhile, the pressure block 624 is pressed against the fixing roller 61, and thereby is also elastically deformed in a direction of flexing a central portion of the pressure block 624 relative to the opposite ends of the pressure block 624.

Figure 6:
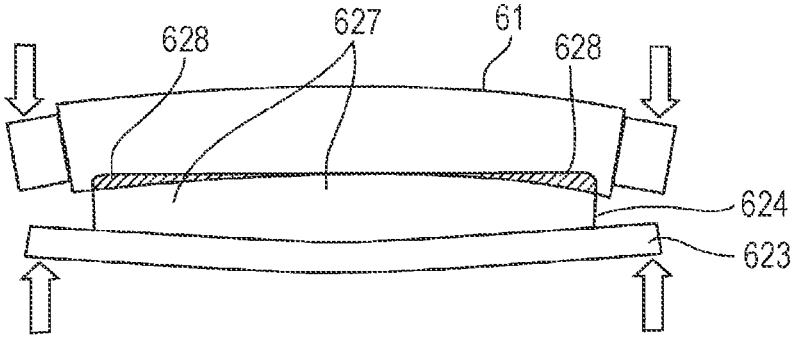
FIG. 6 is a conceptual diagram illustrating a deformed state of a fixing roller and a pressure block.

FIG. 6 is a conceptual diagram illustrating a deformed state of the fixing roller 61 and the pressure block 624. In FIG. 6, the upper and lower sides are opposite to those of FIGS. 1 and 2.

The fixing roller 61 receives the force of the pressure block 624, while being supported at the opposite ends thereof. Thus, the fixing roller 61 is elastically deformed in the direction of flexing the central portion thereof. The nip forming portion 627 of the pressure block 624 is formed to be thicker in a central portion thereof than in end portions thereof such that the pressure force applied to the circumferential surface of the fixing roller 61 is substantially equal from a central portion of the circumferential surface to each of end portions of the circumferential surface (also see FIGS. 4 and 5). Further, together with the support member 623 supporting the pressure block 624, the pressure block 624 is elastically deformed in the direction of flexing the central portion thereof. Such flexural deformation of the fixing roller 61 and the pressure block 624 causes bending deformation in the belt 621 (not illustrated in FIG. 6; see FIGS. 4 and 5) and a sheet passing through between the fixing roller 61 and the nip forming portion 627, making the belt 621 and the sheet project toward the upper side of FIG. 6 (i.e., toward the fixing roller 61).

At a position upstream of the nip region R where such bending deformation occurs, the belt thrusting portion 628 of the pressure block 624 projects toward the fixing roller 61, and thrusts end portions of the belt 621 and the sheet in a direction of suppressing the bending deformation before the end portions enter the nip region R. Therefore, the degree of the bending deformation occurring in the belt 621 and the sheet is small immediately before the belt 621 and the sheet enter the nip region R. In the example illustrated in FIG. 6, the thrust by the belt thrusting portion 628 is adjusted to an extent that offsets the bending deformation occurring in the nip region R. Therefore, the belt 621 and the sheet are substantially flat when passing over the belt thrusting portion 628.

Figure 7A:
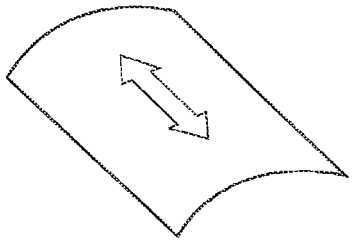
FIGS. 7A to 7C are diagrams illustrating states of a sheet passing the fixing device.
Figure 7B:
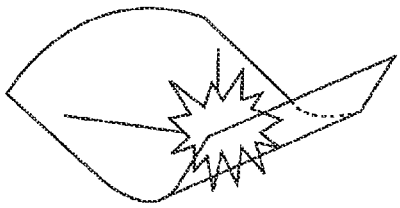
Figure 7C:
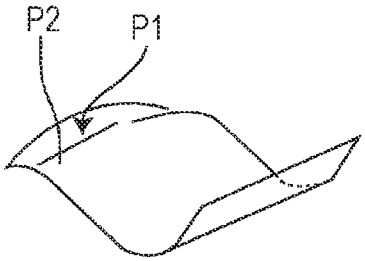

FIGS. 7A to 7C are diagrams illustrating states of the sheet passing the fixing device 60. In FIGS. 7A to 7C, the upper and lower sides are the same as those of FIG. 6, and are opposite to those of FIGS. 1 and 2.

FIG. 7A illustrates the bending deformation occurring in the sheet when the sheet is nipped in the nip region R. The bending deformation occurs in the sheet, making the sheet project toward the upper side of the drawing. Such bending deformation generates, in the sheet, tension acting in the directions indicates by an arrow in the drawing.

FIG. 7B illustrates a state in which a front portion of the sheet is nipped in the nip region R of the fixing device 60 and a rear portion of the sheet is nipped between the transport rollers 83. As illustrated in FIG. 1, a path of the sheet passing the fixing device 60 is bent inward toward the fixing roller 61. While being transported in the direction of the arrow D by the transport rollers 83 provided before the fixing device 60, a portion of the sheet arrives the nip region R of the fixing device 60. This positional relationship is illustrated in FIG. 7B, in which, when the leading end of the sheet located on the far side of the drawing has reached the nip region R, the rear end of the sheet located on the near side of the drawing is pulled toward the upper side of the drawing. If the rear end side of the sheet is oriented in such a direction, the sheet is not easily bent owing to the above-described tension. It is therefore desired to provide a configuration which suppresses the formation of a crease in a central portion of the sheet.

FIG. 7C illustrates a state in which the end portions of the sheet are thrust by the belt thrusting portion 628 of the pressure block 624. When a preceding portion P1 of the sheet is nipped in the nip region R, a subsequent portion P2 subsequent to the preceding portion P1 is thrust toward the upper side of the drawing (i.e., toward the fixing roller 61) at left and right end portions of the subsequent portion P2 in the drawing by the belt thrusting portion 628 of the pressure block 624. As a result, the bending deformation illustrated in FIG. 7A is limited to an area near the nip region R, and the sheet is substantially flat in the subsequent portion P2, as described above. Even if the rear end side of the sheet is pulled toward the upper side of the drawing, therefore, the sheet is easily bent, and a crease is not formed.

The sheet is not necessarily required to be flat, as long as the thrust by the belt thrusting portion 628 is greater in the end portions of the sheet than in the central portion of the sheet. This is because, if the thrust reduces the deformation of the sheet to be less than the bending deformation occurring in the nip region R, the tension of the sheet is reduced accordingly, and the formation of a crease is suppressed. Further, the belt thrusting portion 628 may thrust the end portions of the sheet to an extent that makes the sheet project toward the lower side of the drawing. This is because the above-described tension of the sheet does not obstruct the bending of the sheet toward the lower side of the drawing.

A second exemplary embodiment of the invention will be described below. An image forming apparatus and a fixing device of the second exemplary embodiment are similar to the image forming apparatus and the fixing device of the above-described first exemplary embodiment, except for a difference in structure of the pressure structure. In the following, therefore, the structure of the pressure structure will be particularly described. Further, constituent components similar to those of the first exemplary embodiment will be designated by the same reference numerals, and repetitive description thereof will be omitted.

Figure 8:
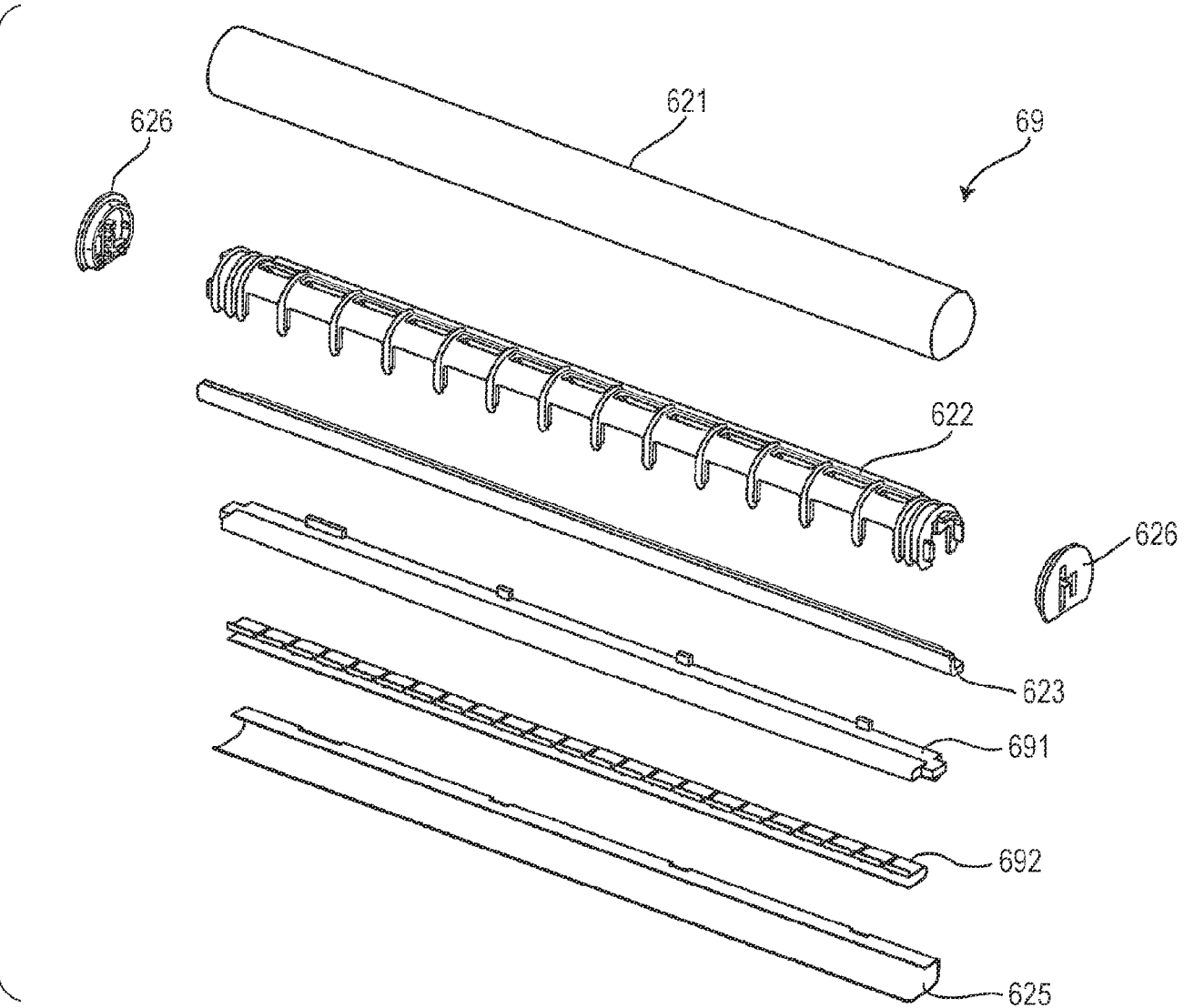
FIG. 8 is an exploded perspective view illustrating a structure of a pressure structure in a second exemplary embodiment of the invention.

FIG. 8 is an exploded perspective view illustrating a structure of a pressure structure in the second exemplary embodiment of the invention.

In a pressure structure 69 in the second exemplary embodiment, the support member 623 supports a base 691, and a plate spring 692 is mounted on the base 691. The plate spring 692 presses the belt 621 from inside the belt 621, and thereby the belt 621 is pressed against the fixing roller 61 (see FIG. 2). The plate spring 692 corresponds to an example of the pressing member of the invention.

With the belt 621 pressed against the fixing roller 61 by the plate spring 692, the nip region R is formed between the pressure structure 69 and the fixing roller 61. The pressing by the plate spring 692 also causes, in the fixing roller 61 and the nip region R, flexure similar to the flexure illustrated in FIG. 6. Further, the bending deformation as illustrated in FIG. 7A occurs in the belt 621 and the sheet passing the nip region R, and the above-described tension is also generated.

Figure 9:
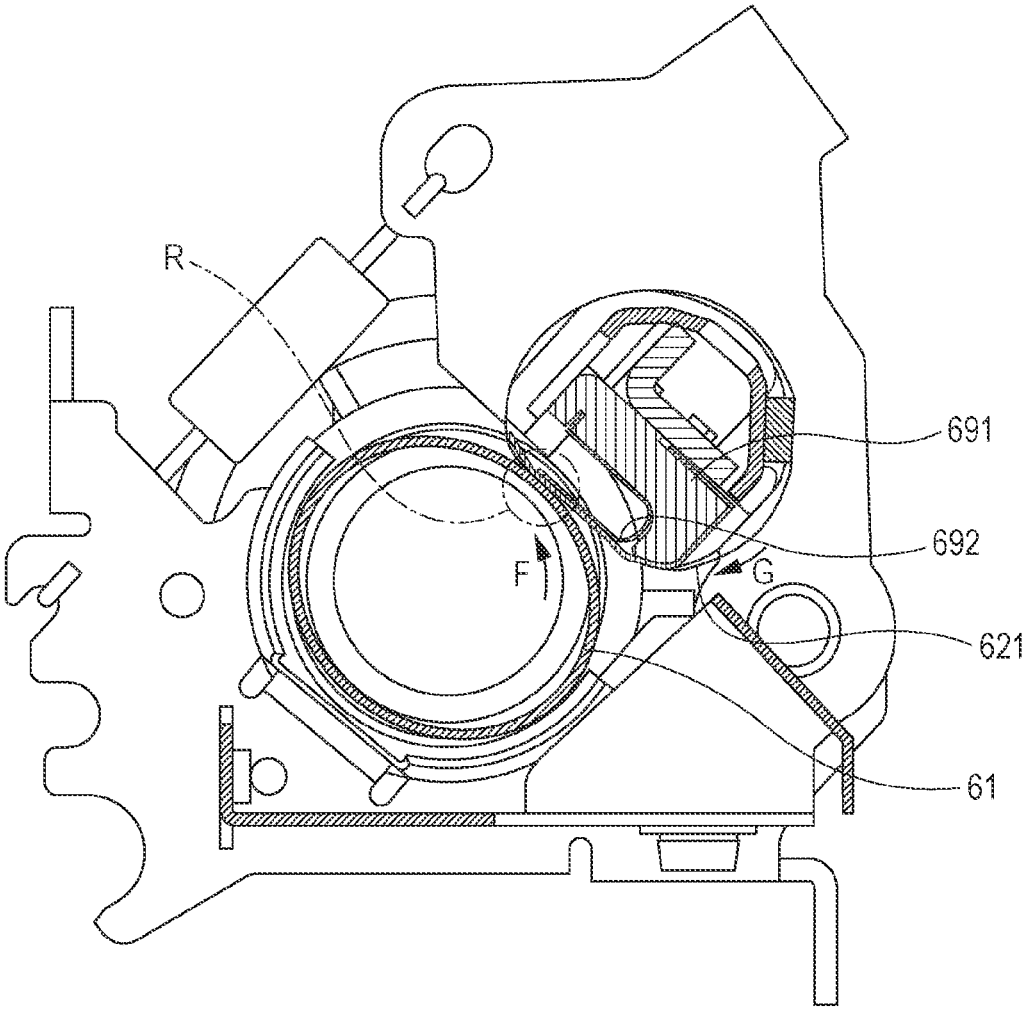
FIG. 9 is a cross-sectional view of a central portion of a fixing device in the second exemplary embodiment of the invention.
Figure 10:
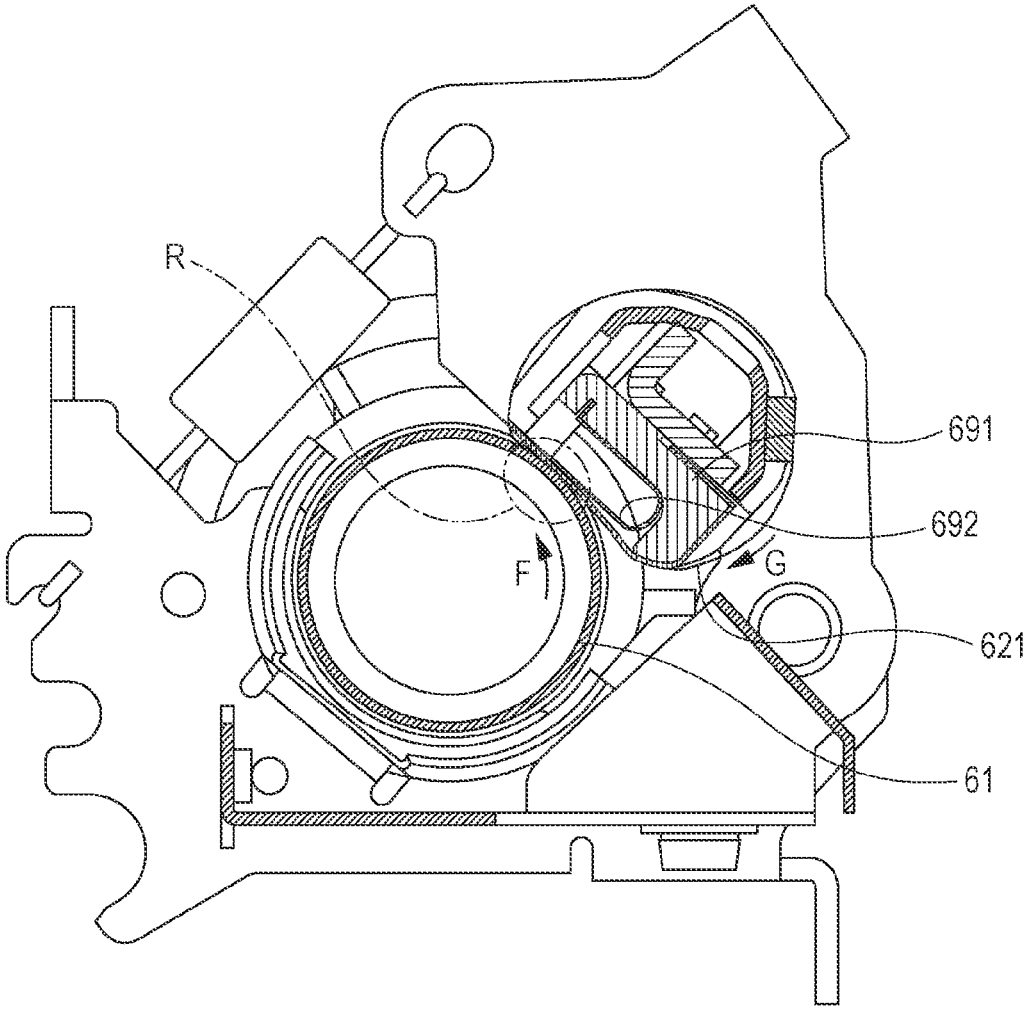
FIG. 10 is a cross-sectional view of an end portion of the fixing device in the second exemplary embodiment of the invention.

FIG. 9 is a cross-sectional view of a central portion of the fixing device in the second exemplary embodiment of the invention. FIG. 10 is a cross-sectional view of an end portion of the fixing device in the second exemplary embodiment of the invention.

As illustrated in FIGS. 9 and 10, the nip region R is formed between the plate spring 692 and the fixing roller 61. At a position upstream of the plate spring 692 in the rotation direction F of the fixing roller 61 and the circular movement direction G of the belt 621, a part of the base 691 projects toward the fixing roller 61. Further, the base 691 thrusts the belt 621 and the sheet toward the fixing roller 61 by using the projecting portion. The thrust exerted on the belt 621 by the base 691 is greater in the end portion illustrated in FIG. 10 than in the central portion illustrated in FIG. 9. That is, the base 691 corresponds to an example of the thrusting member of the invention. With the thrust exerted on the belt 621 and the sheet by the base 691, the sheet in the state illustrated in FIG. 7C enters the fixing device. Accordingly, the formation of a crease in the sheet is suppressed.

In the above-described exemplary embodiments, the heater 63 is provided inside the fixing roller 61. The heat source of the invention, however, may be provided inside the circulating member of the invention, or may be provided independently, not provided inside the cylinder member or the circulating member of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a cylinder member that has a shape of a cylinder and is elastically deformed in a radial direction of the cylinder, and that rotates in a circumferential direction of the cylinder;

a circulating member that has a shape of a cylinder, and that circularly moves in a circumferential direction of the cylinder with an outer circumferential surface thereof pressed against the cylinder member;

a heat source that heats a recording medium, the recording medium which holds an unfixed toner image on a surface thereof and which is nipped between the cylinder member and the circulating member; and a pressing member that is provided inside the circulating member, and that presses the circulating member against the cylinder member from inside the circulating member, the pressing member including a nip forming portion that presses the circulating member and brings the circulating member and the cylinder member into contact with each other, to thereby form a nip region therebetween, and a thrusting portion that thrusts the circulating member before being pressed against the cylinder member, such that the thrust is greater in end portions of the circulating member than in a central portion of the circulating member, the thrusting portion being at a position upstream of the nip forming portion in a moving direction of the circulating member, and the thrusting portion thrusts from inside the circulating member toward the cylinder member, wherein the thrusting portion contacts with the circulating member, and wherein the circulating member forms a circumferential surface of the pressing member and an exterior surface of the circumferential surface of the circulating member is not in contact with the cylinder member at a position directly outside of a region in which all portions of the thrusting portion contacts with an inner surface of the circulating member.

2. The fixing device according to claim 1, wherein the thrusting portion is formed into a substantially flat shape.

3. The fixing device according to claim 1, wherein the thrusting portion is configured to thrust a portion of the recording medium towards the cylinder member after a preceding portion of the recording medium is nipped in the nip forming portion.

4. An image forming apparatus comprising:

a fixing device including a cylinder member that has a shape of a cylinder and is elastically deformed in a radial direction of the cylinder, and that rotates in a circumferential direction of the cylinder, a circulating member that has a shape of a cylinder, and that circularly moves in a circumferential direction of the cylinder with an outer circumferential surface thereof pressed against the cylinder member, a heat source that heats a recording medium, the recording medium which holds an unfixed toner image on a surface thereof and which is nipped between the cylinder member and the circulating member, and a pressing member that is provided inside the circulating member, and that presses the circulating member against the cylinder member from inside the circulating member, the pressing member including a nip forming portion that presses the circulating member and brings the circulating member and the cylinder member into contact with each other, to thereby form a nip region therebetween, and a thrusting portion that thrusts the circulating member before being pressed against the cylinder member such that the thrust is greater in end portions of the circulating member than in a central portion of the circulating member, the thrusting portion being at a position upstream of the nip forming portion in a moving direction of the circulating member, and from inside the circulating member toward the cylinder member; and an image forming device that forms the unfixed toner image on the surface of the recording medium, wherein the thrusting portion contacts with the circulating member, and wherein the circulating member forms a circumferential surface of the pressing member and an exterior surface of the circumferential surface of the circulating member is not in contact with the cylinder member at a position directly outside of a region in which all portions of the thrusting portion contacts with an inner surface of the circulating member.

5. A fixing method comprising:

causing a cylinder member having a shape of a cylinder to rotate in a circumferential direction of the cylinder;

causing a circulating member having a shape of a cylinder to circularly move in a circumferential direction of the cylinder, with an outer circumferential surface thereof pressed against the cylinder member;

thrusting the circulating member from inside the circulating member toward the cylinder member such that the thrust is greater in end portions of the circulating member than in a central portion of the circulating member;

pressing, at a position downstream of the position of the thrusting in a moving direction of the circulating member, the circulating member from inside the circulating member toward the cylinder member, and bringing the circulating member and the cylinder member into contact with each other, to thereby form a nip region therebetween; and heating a recording medium holding an unfixed toner image on a surface thereof and nipped between the cylinder member and the circulating member, and wherein an exterior surface of the circulating member is not in contact with the cylinder member at a position directly outside of a region in which all portions of the position of the thrusting contacts with an inner surface of the circulating member.

6. A fixing device comprising:

a cylinder member that has a shape of a cylinder and is elastically deformed in a radial direction of the cylinder, and that rotates in a circumferential direction of the cylinder;

a circulating member that has a shape of a cylinder, and that circularly moves in a circumferential direction of the cylinder with an outer circumferential surface thereof pressed against the cylinder member;

a heat source that heats a recording medium, the recording medium which holds an unfixed toner image on a surface thereof and which is nipped between the cylinder member and the circulating member; and a pressing member that is provided inside the circulating member, and that presses the circulating member against the cylinder member from inside the circulating member, the pressing member including a nip forming portion that presses the circulating member and brings the circulating member and the cylinder member into contact with each other, to thereby form a nip region therebetween, and a thrusting portion that thrusts the circulating member before being pressed against the cylinder member such that the thrust is greater in end portions of the circulating member than in a central portion of the circulating member, the thrusting portion being at a position upstream of the nip forming portion in a moving direction of the circulating member, and, the thrusting portion thrusts from inside the circulating member toward the cylinder member, wherein a central portion of the nip forming portion is thicker than an end portion of the nip forming portion in an axial direction of the circulating member, and wherein the circulating member forms a circumferential surface of the pressing member and an exterior surface of the circumferential surface of the circulating member is not in contact with the cylinder member at a position directly outside of a region in which all portions of the thrusting portion contacts with an inner surface of the circulating member.

* * * * *